US010655868B2

(12) United States Patent
Tateishi et al.

(10) Patent No.: US 10,655,868 B2
(45) Date of Patent: May 19, 2020

(54) DEVICE FOR CONTROLLING NUMBER OF OPERATING HEAT SOURCE DEVICES, HEAT SOURCE SYSTEM, CONTROL METHOD, AND PROGRAM

(71) Applicant: MITSUBISHI HEAVY INDUSTRIES THERMAL SYSTEMS, LTD., Minato-ku (JP)

(72) Inventors: Koki Tateishi, Tokyo (JP); Satoshi Nikaido, Tokyo (JP); Minoru Matsuo, Tokyo (JP); Toshiaki Ouchi, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 799 days.

(21) Appl. No.: 15/033,312

(22) PCT Filed: Jul. 4, 2014

(86) PCT No.: PCT/JP2014/067970

§ 371 (c)(1),
(2) Date: Apr. 29, 2016

(87) PCT Pub. No.: WO2015/083394

PCT Pub. Date: Jun. 11, 2015

(65) Prior Publication Data

US 2016/0290674 A1 Oct. 6, 2016

(30) Foreign Application Priority Data

Dec. 3, 2013 (JP) ..... 2013-250198

(51) Int. Cl.
*F24F 3/06* (2006.01)
*F24F 11/83* (2018.01)
(Continued)

(52) U.S. Cl.
CPC ..... *F24F 3/06* (2013.01); *F24D 19/1006* (2013.01); *F24F 11/30* (2018.01); *F24F 11/83* (2018.01)

(58) Field of Classification Search
CPC ..... F24D 19/1006; F24D 19/1048
See application file for complete search history.

(56) References Cited

U.S. PATENT DOCUMENTS

2012/0174609 A1 7/2012 Matsuo et al.
2012/0192588 A1* 8/2012 Yamashita ..... F25B 13/00 62/498

FOREIGN PATENT DOCUMENTS

JP 2000-257938 A 9/2000
JP 3354891 B2 12/2002
(Continued)

OTHER PUBLICATIONS

The Written Opinion of the International Searching Authority and International Search Report (forms PCT/ISA/237 and PCT/ISA/210), dated Oct. 7, 2014, for International Application No. PCT/JP2014/067970 are provided, along with English translations thereof.

*Primary Examiner* — Ljiljana V. Ciric
*Assistant Examiner* — Alexis K Cox
(74) *Attorney, Agent, or Firm* — Birch, Stewart, Kolasch & Birch, LLP

(57) ABSTRACT

A controller for controlling a number of operating heat sources is provided. The controller detects a change in a number of secondary pumps that supply a heat transfer medium to a load device, determines the number of operating heat sources that changes as a load demand of the state of a load device changes, and switches the number of operating heat sources. The controller determines the number of operating heat sources when the change in the number of secondary pumps due to the change in the load demand is detected, and changes the number of heat sources for as
(Continued)

long as at least one of a prescribed period has passed from a time when the change in the number of secondary pumps is detected or a prescribed condition with respect to a value that varies due to the change in the number of secondary pumps is satisfied.

5 Claims, 11 Drawing Sheets

(51) Int. Cl.
*F24F 11/30* (2018.01)
*F24D 19/10* (2006.01)

(56) References Cited

FOREIGN PATENT DOCUMENTS

| | | | |
|---|---|---|---|
| JP | 2006-153324 | A | 6/2006 |
| JP | 2007-24325 | A | 2/2007 |
| JP | 4669335 | B2 | 4/2011 |
| JP | 2011-106699 | A | 6/2011 |
| JP | 2011-153809 | A | 8/2011 |
| JP | 2011-185560 | A | 9/2011 |

* cited by examiner

DEVICE FOR CONTROLLING NUMBER OF OPERATING HEAT SOURCE DEVICES, HEAT SOURCE SYSTEM, CONTROL METHOD, AND PROGRAM

TECHNICAL FIELD

The present invention relates to a device for controlling the number of operating heat source devices, a heat source system, a control method, and a program.

This application claims priority based on Japanese Patent Application No. 2013-250198 filed in Japan on Dec. 3, 2013, of which the contents are incorporated herein by reference.

BACKGROUND ART

In heat source systems such as room cooling and heating, there are technologies for increasing and decreasing the number of operating heat source devices that feed a medium such as chilled water or hot water to air conditioners in accordance with the load demand from the air conditioners (Patent Document 1). In this type of heat source system, in addition to a primary pump that feeds heat transfer medium to the heat source device, frequently a secondary pump is provided between the heat source device and the air conditioner for the purpose of re-pressurizing and feeding the heat transfer medium to air conditioners distant from the heat source device. Also, in the case of such a configuration, normally the heat source device and the secondary pump are controlled independently.

As disclosed in Patent Document 1, the number of heat source devices is determined in accordance with the measured value of the flow rate of the heat transfer medium flowing in a primary pipe (primary pipe flow rate) or the measured value of the load at the air conditioner, for example, on the basis of the demand from the load side. Specifically, when the primary pipe flow rate or the measured load value increases, the number of operating heat source devices is controlled to be increased, and when the primary pipe flow rate or the measured load value decreases, the number of operating units is controlled to be decreased.

CITATION LIST

Patent Literature

Patent Document 1: Japanese Unexamined Patent Application Publication No. 2000-257938A

SUMMARY OF INVENTION

Technical Problem

The primary pipe flow rate or the measured load value at the air conditioner is affected by the operation of the secondary pump. In particular, immediately after increasing or decreasing the number of operating secondary pumps, there is a transient increase or decrease in the primary pipe flow rate or the measured load value, so a value that is different from the value at the subsequent steady state is produced.

FIGS. 14A to 14C are diagrams to explain the temporary increase in the primary pipe flow rate immediately after increasing the number of secondary pumps.

FIGS. 14A to 14C show the pump frequency and primary pipe flow rate behavior in time history when a second "secondary pump 2" is started up in order to switch to two pump operation associated with an increase in load demand from an air conditioner from a state of single "secondary pump 1" operation. FIG. 14A shows that "secondary pump 1" operates at a frequency of 50 Hz until the time "t71", and thereafter the output frequency of "secondary pump 1" is reduced to a continuous 25 Hz in order to operate each pump at an equal frequency in accordance with two pump operation. FIG. 14B shows the frequency behavior of "secondary pump 2" in the case that the same frequency command value is applied to "secondary pump 2" as for "secondary pump 1" so that it starts up at the time "t71". Immediately after starting up, "secondary pump 2" operates at the frequency 50 Hz in order to operate at the same frequency as "secondary pump 1", and eventually settles down to the target operation at 25 Hz. FIG. 14C shows that the primary pipe flow rate temporarily increases as a result of the effect of operation of "secondary pump 2" immediately after startup of "secondary pump 2". Note that in FIGS. 14A to 14C an example is illustrated of the case in which "secondary pump 2" is operated at the same frequency as "secondary pump 1". However even in a case in which "secondary pump 2" is operated differently from the "secondary pump 1" with as low a frequency as possible gradually increasing to 25 Hz, normally there is a lower limit value to the frequency command value received by the pump, so it is not possible to avoid a transient increase in the primary pipe flow rate due to startup of the "secondary pump 2".

In this case, if, for example, the number of heat source devices operating is controlled by the primary pipe flow rate, there is a possibility that the number of operating heat source devices will be increased by one device due to the temporary increase in primary pipe flow rate after the time "t71". However, this increase in primary pipe flow rate is temporary, and after a while the primary pipe flow rate returns to its original value. Under these circumstances, there is a possibility that the number of heat source devices operating that is determined from the temporary change in the primary pipe flow rate will be inappropriate. Also, the successive increase and decrease in the number of heat source devices operating associated with the increase and decrease in the transient flow rate due to the increase or decrease in the secondary pumps is wasteful, and is not desirable from the point of view of stable operation of the system. In the conventional technology such as this, the number of units operating is increased or decreased in accordance with the measured value of the primary pipe flow rate or the like, without taking into consideration the effect of the increase or decrease in the number of secondary pumps, so there is a possibility that the number of heat source devices operating will increase or decrease in accordance with the transient primary pipe flow rate or measured load value.

The present invention provides a device for controlling the number of operating heat source devices, a heat source system, a control method, and a program that can solve these issues.

Solution to Problem

According to a first aspect of the present invention, a device for controlling the number of operating heat source devices comprises: a unit for switching the number of operating heat source devices that, when there is a change in the number of operating pumps provided between a load device and a heat source device that supplies a heat transfer medium to the load device, the pumps transporting the heat transfer medium to the load device, determines the number of operating heat source devices on the basis of the state of the load device prior to the change in the number of operating pumps, until at least one of a prescribed condition with respect to time or a prescribed condition with respect to a value that varies due to the change in the number of operating pumps is satisfied.

According to a second aspect of the present invention, the prescribed condition with respect to time is a predetermined period of time from the time that the number of operating pumps changes or a period of time set in accordance with operating conditions.

According to a third aspect of the present invention, the prescribed condition with respect to the value that varies is a frequency of the pump that varies due to the change in the number of operating pumps becoming a value within a prescribed range in a prescribed period of time.

According to a fourth aspect of the present invention, the prescribed condition with respect to the value that varies is a value of the difference in a heat source device output value of the heat source device that varies due to the change in the number of operating pumps and a measured value of the load of the load device becoming a value within a prescribed range in which the heat source device output value and the measured value of the load can be considered to be equal.

According to a fifth aspect of the present invention, the device for controlling the number of operating heat source devices further comprises a unit for controlling a secondary bypass valve that controls a degree of opening of a secondary bypass adjustment valve that adjusts a flow rate of a secondary bypass connected in parallel to the pump, wherein when the number of operating pumps changes, the unit for controlling the secondary bypass valve controls the secondary bypass adjustment valve so that the flow rate of the heat transfer medium transported to the load device from the pump becomes a target flow rate.

According to a sixth aspect of the present invention, the device for controlling the number of operating heat source devices, comprises: a unit for switching the number of operating heat source devices that determines the number of operating heat source devices that supply a heat transfer medium to a load device on the basis of a measured value relating to the load device;

a unit for controlling a secondary bypass valve that controls a degree of opening of a secondary bypass adjustment valve that adjusts a flow rate of a secondary bypass connected in parallel to a pump provided between the load device and the heat source device and that transports the heat transfer medium to the load device; when the number of operating pumps changes, the unit for controlling the secondary bypass valve controls the secondary bypass adjustment valve so that the flow rate of the heat transfer medium transported to the load device from the pump becomes a target flow rate.

According to a seventh aspect of the present invention, a heat source system comprises: a load device; a plurality of heat source devices that supply a plurality of heat transfer mediums; a plurality of pumps that transport the heat transfer medium supplied by the heat source device to the load device; a secondary pump control device that controls the number of operating pumps; and the device for controlling the number of operating heat source devices according to any one of the above first to sixth aspects.

According to an eighth aspect of the present invention, a method of controlling the number of operating heat source devices comprises: when there is a change in the number of operating pumps provided between a load device and a heat source device that supplies a heat transfer medium to the load device, the pumps transporting the heat transfer medium to the load device; determining, using a device for controlling the number of operating heat source devices, the number of operating heat source devices on the basis of the state of the load device prior to the change in the number of operating pumps, until at least one of a prescribed condition with respect to time or a prescribed condition with respect to a value that varies due to the change in the number of operating pumps is satisfied.

According to a ninth aspect of the present invention, a method of controlling the number of operating heat source devices comprises: determining, using a unit for switching the number of operating heat source devices, the number of operating heat source devices that supply a heat transfer medium to a load device on the basis of a measured value relating to the load device; and controlling, using a unit for controlling a secondary bypass valve, a degree of opening of a secondary bypass adjustment valve that adjusts a flow rate of a secondary bypass connected in parallel to a pump provided between the load device and the heat source device and that transports the heat transfer medium to the load device; and controlling the secondary bypass adjustment valve so that a flow rate of the heat transfer medium that is transported from the pump to the load device is a target flow rate, when the number of operating pumps changes.

According to a tenth aspect of the present invention, a program causes a computer of a device for controlling the number of operating heat source devices to function as means for determining, when there is a change in the number of operating pumps provided between a load device and a heat source device that supplies a heat transfer medium to the load device, the pumps transporting the heat transfer medium to the load device, the number of operating heat source devices on the basis of the state of the load device prior to the change in the number of operating pumps, until at least one of a prescribed condition with respect to time or a prescribed condition with respect to a value that varies due to the change in the number of operating pumps is satisfied.

According to an eleventh aspect of the present invention, a program causes a computer of a device for controlling the number of operating heat source devices to function as means for determining the number of operating heat source devices that supply a heat transfer medium to a load device on the basis of a measured value relating to the load device; and means for controlling a degree of opening of a secondary bypass adjustment valve that adjusts a flow rate of a secondary bypass connected in parallel to a pump provided between the load device and the heat source device and that transports the heat transfer medium to the load device, and controlling the secondary bypass adjustment valve so that a flow rate of the heat transfer medium that is transported from the pump to the load device is a target flow rate, when the number of operating pumps changes.

Advantageous Effects of Invention

According to the aspects of the present invention as described above, it is possible to control the number of operating heat source devices appropriately without being affected by a transient change in the measured value of flow rate or measured value of load caused by the increase or decrease in the number of operating secondary pumps.

DESCRIPTION OF EMBODIMENTS

First Embodiment

The following is a description of the heat source system according to a first embodiment of the present invention, with reference to FIGS. 1 to 4, and FIGS. 14A, 14B, and 14C.

Figure 1:
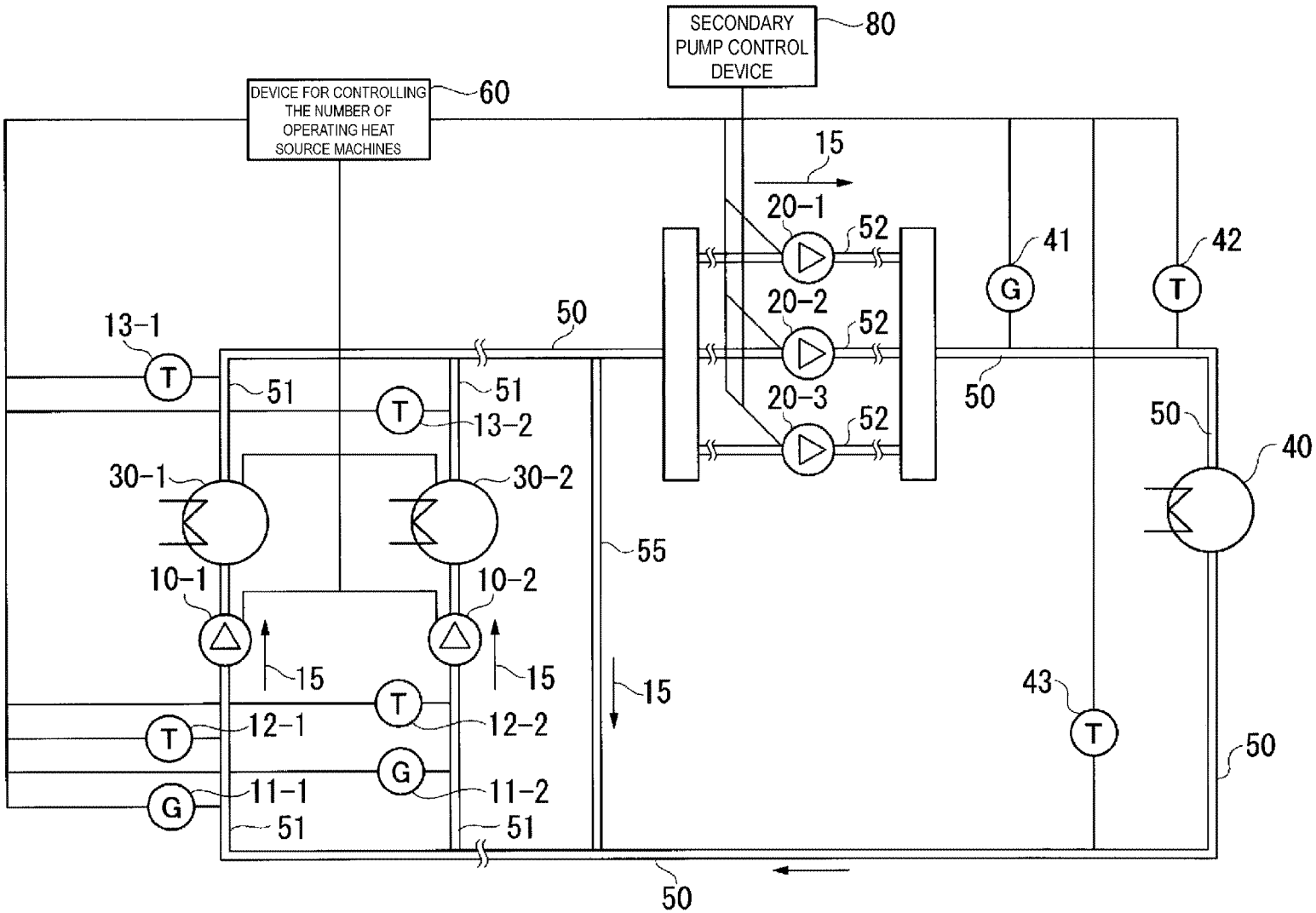
FIG. 1 is a schematic view of a heat source system according to first to third embodiments of the present invention.

FIG. 1 is a schematic view of the heat source system according to first to third embodiments of the present invention.

As illustrated in FIG. 1, the heat source system according to the present embodiment includes a heat source device 30-1, a heat source device 30-2, a primary pump 10-1, a primary pump 10-2, a flow rate meter 11-1, a flow rate meter 11-2, a thermometer 12-1, a thermometer 12-2, a thermometer 13-1, a thermometer 13-2, a secondary pump 20-1, a secondary pump 20-2, a secondary pump 20-3, a load device 40, a flow rate meter 41, a thermometer 42, a thermometer 43, piping 50, piping 51, piping 52, piping 55, and a device for controlling the number of operating heat source devices 60.

Also, the primary pump 10-1 and the primary pump 10-2 are generically referred to as the primary pump 10. Likewise, the flow rate meter 11-1 and the flow rate meter 11-2 are generically referred to as the flow rate meter 11; the thermometer 12-1 and the thermometer 12-2 are generically referred to as the thermometer 12; the thermometer 13-1 and the thermometer 13-2 are generically referred to as the thermometer 13; the secondary pump 20-1, the secondary pump 20-2, and the secondary pump 20-3 are generically referred to as the secondary pump 20; and the heat source device 30-1 and the heat source device 30-2 are generically referred to as the heat source device 30.

The heat source device 30 is a device that supplies a heat transfer medium to load device such as air conditioners. The heat transfer medium fed by the heat source device 30 flows through the piping 50, 51, 52, in the direction indicated by the reference sign 15.

In the present embodiment the heat transfer medium is, for example, water (hot water, chilled water). In addition, the heat transfer medium may be air or a special gas or the like. In the present Specification a medium for cooling and a medium for heating are each generically referred to as a heat transfer medium.

The primary pump 10 feeds the heat transfer medium under pressure to the heat source device 30. In the heat source system according to the present embodiment, a plurality of the combination of the heat source devices 30 and the primary pumps 10 is disposed connected in parallel. A single heat source device 30 and primary pump 10 is connected to the piping 50, which is a primary pipe, via the piping 51, which is a branch pipe. The piping 55 is a communication pipe provided to stabilize the difference in pressure between the inlet side of the secondary pump 20 and the inlet side of the heat source device 30.

The flow rate meter 11 is a flow rate meter that measures the flow rate of the heat transfer medium in the piping 51. The thermometer 12 is a thermometer that measures the temperature of the heat transfer medium in the piping 51 returning to the heat source device 30 from the load (recirculated water temperature). The thermometer 13 is a thermometer that measures the temperature of the heat transfer medium in the piping 51 being fed to the load (feed water temperature). The flow rate meter 11 and the thermometers 12, 13 are provided on each piping 51 for each combination of heat source device 30 and primary pump 10.

The secondary pump 20 delivers the heat transfer medium supplied by the heat source device 30 to the load device 40. The secondary pump 20 is provided with the purpose of re-pressurizing and feeding the heat transfer medium so that it can arrive at a load device 40 that is distant from the heat source device 30. A plurality of the secondary pumps 20 is disposed connected in parallel between the heat source device 30 and the load device 40, and a single secondary pump 20 is connected to the piping 50, which is the primary pipe, via the piping 52, which is a branch pipe.

The load device 40 is an air conditioner such as, for example, a room heating or cooling device, that dissipates or absorbs the heat of the supplied heat transfer medium, and thereafter returns the heat transfer medium to the heat source device 30.

The flow rate meter 41 is a flow rate meter that measures the primary pipe flow rate of the heat transfer medium in the piping 50. The thermometer 42 is a thermometer that measures the feed water temperature of the heat transfer medium fed to the load in the piping 50. The thermometer 43 is a thermometer that measures the temperature of the recirculated water temperature of the heat transfer medium from the load in the piping 50.

The device for controlling the number of operating heat source devices 60 is a device that controls the increase or decrease in the number of operating heat source devices 30 in accordance with the load demand required by the load device 40.

Note that in FIG. 1 there are two heat source devices 30 and two primary pumps 10, and there are three secondary pumps 20 installed, but the numbers are not limited to these numbers. For example six heat source devices 30 and six primary pumps 10 and nine secondary pumps 20 may be installed.

Also, in this heat source system, a secondary pump control device 80 that controls the number of operating secondary pumps 20 is provided in order to adjust the flow rate of the heat transfer medium in accordance with the load demand of the load device 40.

Figure 2:
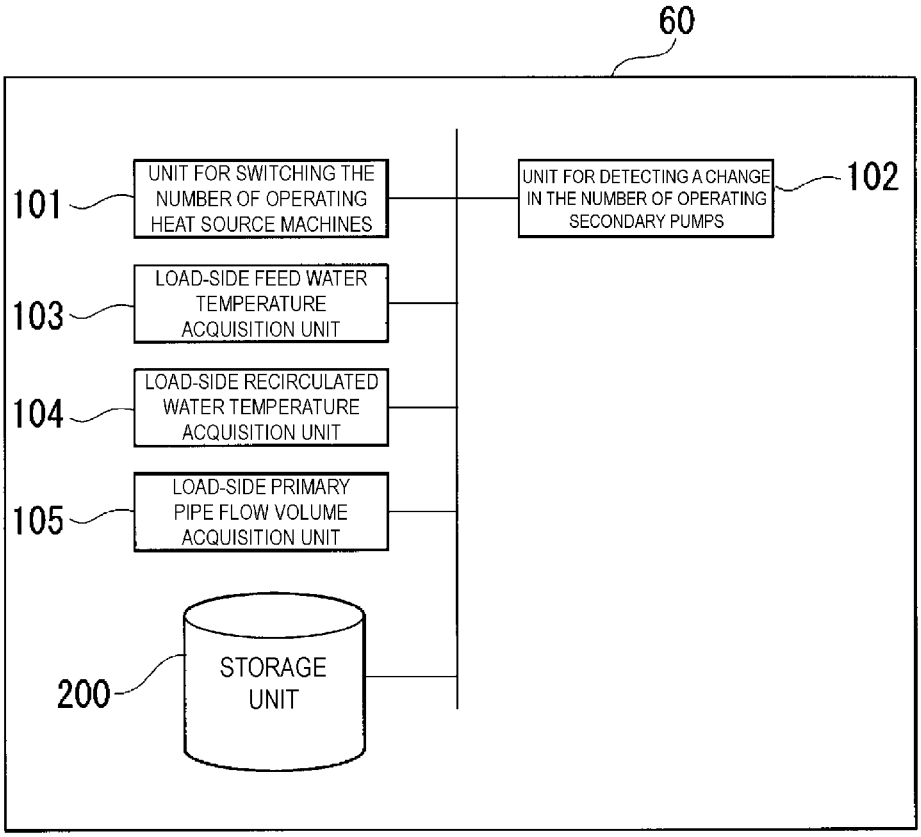
FIG. 2 is a function block diagram of a device for controlling the number of operating heat source devices according to the first embodiment of the present invention.

FIG. 2 is a function block diagram of the device for controlling the number of operating heat source devices according to the first embodiment of the present invention.

The device for controlling the number of operating heat source devices 60 according to the present embodiment is described using FIG. 2.

As illustrated in FIG. 2, the device for controlling the number of operating heat source devices 60 includes a unit for switching the number of operating heat source devices 101, a unit for detecting a change in the number of operating secondary pumps 102, a load-side feed water temperature acquisition unit 103, a load-side recirculated water temperature acquisition unit 104, a load-side primary pipe flow volume acquisition unit 105, and a storage unit 200.

The unit for switching the number of operating heat source devices 101 detects the number of heat source devices 30 and primary pumps 10 operating, determines the appropriate number of heat source devices 30 operating in accordance with the status of the load device 40 determined using measured values of the load device (load demand, flow rate, recirculating water temperature, and the like), and stops or starts heat source devices 30 and primary pumps 10. In particular when the number of secondary pumps 20 operating has changed, the number of operating heat source devices 30 and the like is determined on the basis of the status of the load device before the number operating was changed until a predetermined condition regarding the times or fluctuation in values due to this change is satisfied.

The unit for detecting a change in the number of operating secondary pumps 102 detects that the number of operating secondary pumps 20 has switched when there is a change in the number operating. For example, the unit for detecting a change in the number of operating secondary pumps 102 may detect a change in the number operating by acquiring information from the secondary pump control device 80 indicating that the number of secondary pumps 20 operating has changed.

The load-side feed water temperature acquisition unit 103 acquires the temperature of the heat transfer medium measured by the thermometer 42, and stores the temperature in correspondence with the time acquired in the storage unit 200.

The load-side recirculated water temperature acquisition unit 104 acquires the temperature of the heat transfer medium measured by the thermometer 43, and stores the temperature in correspondence with the time acquired in the storage unit 200.

The load-side primary pipe flow volume acquisition unit 105 acquires the flow rate of the heat transfer medium measured by the flow rate meter 41, and stores the flow rate in correspondence with the time acquired in the storage unit 200.

The storage unit 200 retains information such as the various parameters necessary for the unit for switching the number of operating heat source devices 101 to determine the number of heat source devices 30 and primary pumps 10 to operate, and the temperature and flow rate information measured by each measuring instrument for a constant period of time.

Next, the method by which the unit for switching the number of operating heat source devices 101 determines the number of heat source devices 30 and primary pumps 10 operating is described. There are various formats of methods for determining the number of heat source devices 30 operating, but the "control method based on the primary pipe flow rate" and the "control method based on the system load measured value" are described as representative.

[Control Method Based on the Primary Pipe Flow Rate]

The control method based on the primary pipe flow rate considers the primary pipe flow rate to be the load demand from the load device 40, and when the measured value of the primary pipe flow rate per unit time exceeds a predetermined increasing flow rate threshold value the number of operating heat source devices 30 is increased, and when the measured value of the primary pipe flow rate is less than a predetermined decreasing flow rate threshold value the number of operating heat source devices 30 is reduced. The measured value of the primary pipe flow rate is the flow rate of the heat transfer medium measured by the flow rate meter 41.

The predetermined increasing flow rate threshold value and decreasing flow rate threshold value are stored in the storage unit 200 in correspondence with the number of operating heat source devices 30. For example, the increasing flow rate threshold value required to increase the number of operating heat source devices 30 to two when the number of heat source devices 30 operating is one is defined as "X1", the increasing flow rate threshold value required to increase the number of operating heat source devices 30 to three when the number of heat source devices 30 operating is two is defined as "X2", the decreasing flow rate threshold value to decrease to one when the number of heat source devices 30 operating is two is defined as "Y2".

In this control format, the unit for switching the number of operating heat source devices 101 reads the increasing flow rate threshold value and the decreasing flow rate threshold value stored in the storage unit 200 for the current number operating, and compares them with the primary pipe flow rate measured by the flow rate meter 41 acquired from the load-side primary pipe flow volume acquisition unit 105. Then in the case of the example as described above, if the current number operating is one, and the primary pipe flow rate per unit time exceeds "X1" $m^3$, the unit for switching the number of operating heat source devices 101 increases the number operating to two, and if the current number operating is two and the primary pipe flow rate per unit time is less than "Y2" $m^3$, the unit for switching the number of operating heat source devices 101 decreases the number operating to one.

[Control Method Based on the System Load Measured Value]

The control method based on the system load measured value considers the measured value of system load to be the load demand from the load device 40, and when the measured value of the system load exceeds a predetermined increasing flow rate threshold value the number of operating heat source devices 30 is increased, and when the measured value of the system load is less than a predetermined decreasing flow rate threshold value the number of operating heat source devices 30 is reduced. The measured value of system load can be defined in various ways, for example the value that can be calculated from the following equation (1).

Measured value of system load=primary pipe flow rate×(|recirculated water temperature−feed water temperature|)×specific heat of heat transfer medium×specific gravity of heat transfer medium (1)

In equation (1), the primary pipe flow rate is the value measured by the flow rate meter 41, the recirculated water temperature is the value measured by the thermometer 43, and the feed water temperature is the value measured by the thermometer 42.

In the control method based on the measured value of system load, the predetermined increasing load threshold value and decreasing load threshold value are determined in advance for each number operating in the same way as for the increasing flow rate threshold value and decreasing flow rate threshold value in the control method based on the primary pipe flow rate, and stored in the storage unit 200. Alternatively, these threshold values may be obtained by calculation.

One example of a method for calculating the increasing load threshold value is the following equation (2).

Increasing load threshold value=(rated load of heat source device 30-1)×0.8 (2)

According to this equation, when a certain one heat source device 30-1 is in the operating state, and the calculated value of system load calculated from equation 1 exceeds 80% of the rated load of the heat source device 30-1, the unit for switching the number of operating heat source devices 101 starts up another heat source device 30-2.

Also, one example of a method for calculating the decreasing load threshold value is the following equation (3).

Decreasing load threshold value=(rated load of heat source device 30-1)×0.6 (3)

According to this equation, when two heat source devices 30-1, 30-2 with equal rated load are in the operating state, and the calculated value of system load calculated from equation (1) is less than 60% of the rated load of one heat source device 30-1, the unit for switching the number of operating heat source devices 101 decreases the number of heat source device 301 operating to one.

Next, the problem in the case of increasing or decreasing the number of heat source devices 30 and primary pumps 10 in the formats as described above is described using FIGS. 14A to 14C.

Figure 14A:
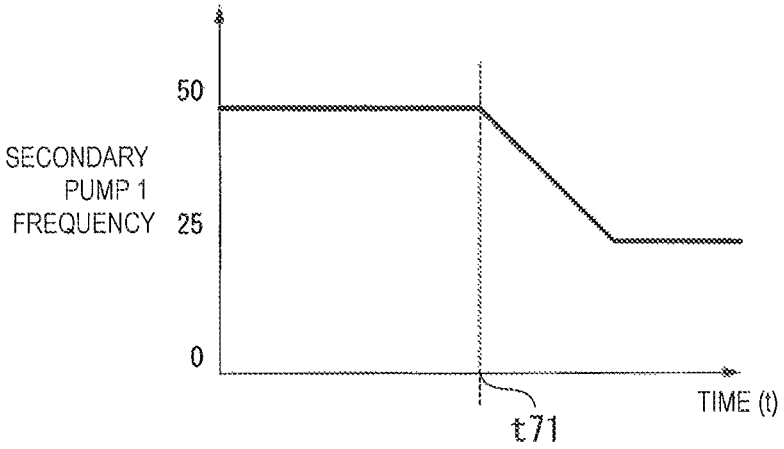
FIG. 14A PRIOR ART
FIG. 14A is a first diagram to explain the temporary increase in the primary pipe flow rate immediately after increasing the number of secondary pumps.
Figure 14B:
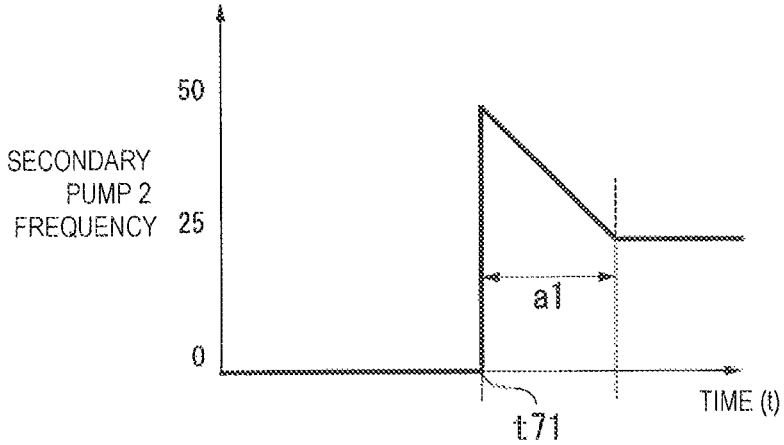
FIG. 14B PRIOR ART
FIG. 14B is a second diagram to explain the temporary increase in the primary pipe flow rate immediately after increasing the number of secondary pumps.
Figure 14C:
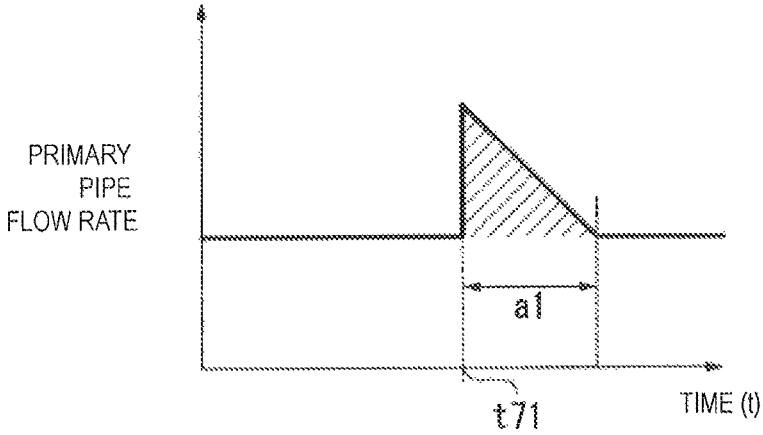
FIG. 14C PRIOR ART
FIG. 14C is a third diagram to explain the temporary increase in the primary pipe flow rate immediately after increasing the number of secondary pumps.

FIG. 14A is a first diagram to explain the temporary increase in the primary pipe flow rate immediately after increasing the number of secondary pumps. FIG. 14B is a second diagram to explain the temporary increase in the primary pipe flow rate immediately after increasing the number of secondary pumps. FIG. 14C is a third diagram to explain the temporary increase in the primary pipe flow rate immediately after increasing the number of secondary pumps.

Using FIGS. 14A to 14C, the effect on the primary pipe flow rate of increasing the number of operating secondary pumps from one to two is described. The condition indicated in FIGS. 14A to 14C is a situation in which one secondary pump 20 is operating, but due to the demand of the load device a second secondary pump 20 is started up. Also, the two pumps operate at the same frequency, and the frequency of the two pumps is determined on the basis of the outlet pressure which is predetermined in accordance with the load demand.

FIG. 14A is a graph showing the frequency of the first secondary pump 20-1 against time. This graph shows that the secondary pump 20-1 operates at 50 Hz until the second secondary pump starts up at the time "t71", and thereafter the frequency is gradually reduced, and finally it operates at the frequency 25 Hz.

FIG. 14B shows the frequency behavior when the same frequency command value is applied to the second secondary pump 20-2 as the secondary pump 20-1 so that it starts up at the time "t71". The frequency of the secondary pump 20-2 is gradually reduced from 50 Hz the same as for the secondary pump 20-1, and eventually reaches 25 Hz.

The graph of FIG. 14C shows the primary pipe flow rate behavior measured by the flow rate meter 41 when two secondary pumps are operated as shown in FIGS. 14A and 14B. As shown in this graph, the primary pipe flow rate temporarily increases with the startup of the second secondary pump, and eventually the flow rate settles to the flow rate before increasing the number of secondary pumps 20 operating.

In the heat source system provided with the secondary pump as illustrated in FIG. 1, the phenomenon that there is a transient increase or decrease in the primary pump flow rate immediately after either increasing or decreasing the number of operating secondary pumps, which eventually settles to a steady condition. In this heat source system, when the number of heat source devices 30 and primary pumps 10 operating is controlled by the "control method based on primary pipe flow rate" or the "control method based on the system load measured value" as described above, the number of operating heat source devices 30 and the like is determined on the basis of the primary pipe flow rate that has transiently increased or decreased, or the system load measurement value calculated using this. When the number of operating heat source devices 30 and the like is switched in accordance with the temporary fluctuation in load demand in this way, it is necessary to again restore the number operating to the original number when the state has settled. This has the problem that the system efficiency is reduced because the optimum number of heat source devices is not operating.

Therefore in the present embodiment the number of heat source devices 30 and primary pumps 10 operating is controlled taking into consideration the transient change in primary pipe flow rate. Specifically, the unit for switching the number of operating heat source devices 101 controls the number of operating heat source devices 30 on the basis of the load demand before the change in the number of operating secondary pumps 20, during the period from the time when the number of operating secondary pumps has changed until a predetermined period of time has passed. Here the predetermined period of time is a predetermined period of time indicating, for example, the time until the fluctuation in the primary pipe flow rate of the heat transfer medium supplied to the load device 40 reaches a steady state. The following is a description of the method.

Figure 3:
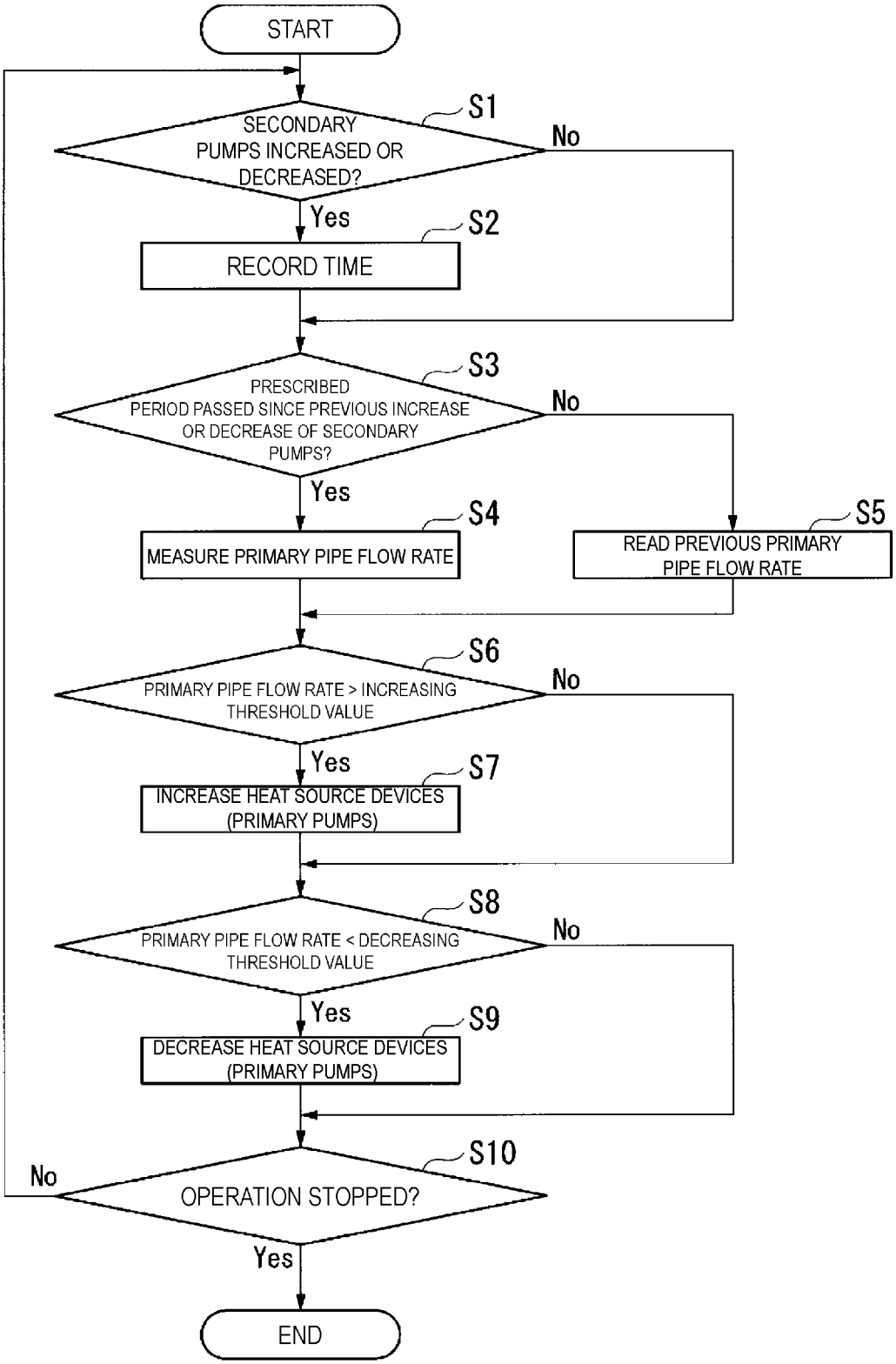
FIG. 3 is a first diagram illustrating the process flow of the device for controlling the number of operating heat source devices according to the first embodiment of the present invention.

FIG. 3 is a first diagram illustrating the process flow of the device for controlling the number of operating heat source devices according to the present embodiment.

The process by which the device for controlling the number of operating heat source devices 60 determines the number of operating heat source devices 30 using the "control method based on the primary pipe flow rate" is described using the process flow of FIG. 3.

It is assumed that the heat source system illustrated in FIG. 1 is operating, the device for controlling number of operating heat source devices 60 controls the number of heat source devices 30 and primary pumps 10 operating in accordance with the increase or decrease in load demand from the load device 40, and the secondary pump control device 80 that is separately provided in the heat source system controls the number of operating secondary pumps. For example, assume the load device 40 is a room cooling device, and when the user changes the setting temperature from 28 to 25° C., the load demand increases, and if necessary as a result, the secondary pump control device 80 increases the number of operating secondary pumps.

First, the unit for detecting a change in the number of operating secondary pumps 102 detects whether or not there has been an increase or decrease in the number of operating secondary pumps (step S1). If an increase or decrease in the number of operating secondary pumps has been detected, the unit for detecting a change in the number of operating secondary pumps 102 stores the time this change was detected in the storage unit 200 (step S2). If an increase or decrease in the number of secondary pumps operating was not detected, the flow proceeds to step S3.

Next, the unit for switching the number of operating heat source devices 101 calculates the elapsed time from the previous time that the number of operating secondary pumps was changed as stored in the storage unit 200 until the present time. Also, the unit for switching the number of operating heat source devices 101 reads the duration of the transient state from the storage unit 200. The duration of the transient state is a value indicating the time from after the number of operating secondary pumps was changed ("t71" in FIGS. 14A to 14C) until the transient change in the primary pipe flow rate reaches a steady state, and the fluctuation of the primary pipe flow rate is reduced to within a predetermined range ("al" in FIGS. 14B and 14C), and is stored in advance in the storage unit 200. Also, the unit for switching the number of operating heat source devices 101 compares this duration of the transient state with the calculated elapsed time (step S3).

This duration of the transient state may be obtained by, for example, measuring the time required for the heat transfer medium to make a circuit in the circulation path of the heat source system, and applying this value. Also, this duration of the transient state may be a predetermined set value or may be freely set by the operator of the heat source system in accordance with the operating conditions such as the characteristics of each of the secondary pumps 20, the length of the circulation path of the heat transfer medium, the quantity of water in the air conditioner (load device 40), or the measured value of the primary pipe flow rate.

As a result of this comparison, if the duration of the transient state or longer has passed since increasing or decreasing the number of operating secondary pumps (step S3=Yes), the unit for switching the number of operating heat source devices 101 acquires the latest measured value of the primary pipe flow rate measured by the flow rate meter 41 via the load-side primary pipe flow volume acquisition unit 105 (step S4).

On the other hand, if the duration of the transient state or longer has not passed since increasing or decreasing the number of operating secondary pumps (step S3=No), the unit for switching the number of operating heat source devices 101 reads from the storage unit 200 the last value measured by the flow rate meter 41 stored by the load-side primary pipe flow volume acquisition unit 105 before the previous time that the number of operating secondary pumps was increased or decreased, as the latest measured value of the primary pipe flow rate (step S5).

Next, the unit for switching the number of operating heat source devices 101 determines the increase or decrease in the number of operating heat source devices 30 or the like by the "control method based on the primary pipe flow rate" using the latest measured value of the primary pipe flow rate.

Specifically, the unit for switching the number of operating heat source devices 101 uses the current number of operating heat source devices 30 to read the increasing flow rate threshold value for the number of heat source devices 30 currently operating that is stored in the storage unit 200.

Then the latest measured value of the primary pipe flow rate and the increasing flow rate threshold value obtained in step S4 and step S5 are compared (step S6).

If as a result of the comparison the latest measured value of the primary pipe flow rate exceeds the increasing flow rate threshold value (step S6=Yes), the unit for switching the number of operating heat source devices 101 determines that the number of heat source devices 30 and primary pumps 10 operating shall be increased by one each, and one heat source device 30 and one primary pump 10 that are currently stopped are started up (step S7).

If as a result of the comparison the latest measured value of the primary pump flow rate is less than the increasing flow rate threshold value (step S6=No), the process proceeds to step S8.

Next, the unit for switching the number of operating heat source devices 101 uses the current number of operating heat source devices 30 to read the decreasing flow rate threshold value for the number of heat source devices 30 currently operating that is stored in the storage unit 200. Then the latest measured value of the primary pipe flow rate and the decreasing flow rate threshold value are compared (step S8).

If as a result of the comparison the latest measured value of the primary pipe flow rate is less than the decreasing flow rate threshold value (step S8=Yes), the unit for switching the number of operating heat source devices 101 determines that the number of heat source devices 30 and primary pumps 10 operating shall be reduced by one each, and one heat source device 30 and one primary pump 10 that are currently operating are stopped (step S9).

If as a result of the comparison the latest measured value of the primary pump flow rate is greater than the decreasing flow rate threshold value (step S8=No), the process proceeds to step S10.

Finally the unit for switching the number of operating heat source devices 101 determines by a predetermined method whether or not the heat source system has been stopped by the operation of the user or the like. If operation of the heat source system has been stopped (step S10=Yes), this process flow is terminated. If operation continues (step S10=No), the process returns to step S1.

According to the "control method based on primary pipe flow rate" of the present embodiment, for a certain duration while the primary pipe flow rate is fluctuating associated with an increase or decrease in the number of operating secondary pumps 20, the number of operating heat source devices 30 is controlled on the basis of the primary pipe flow rate measured prior to the increase or decrease, so it is possible to control the number of operating heat source devices 30 without being affected by the transient fluctuation in the primary pipe flow rate associated with the increase or decrease in the number of operating secondary pumps 20.

Figure 4:
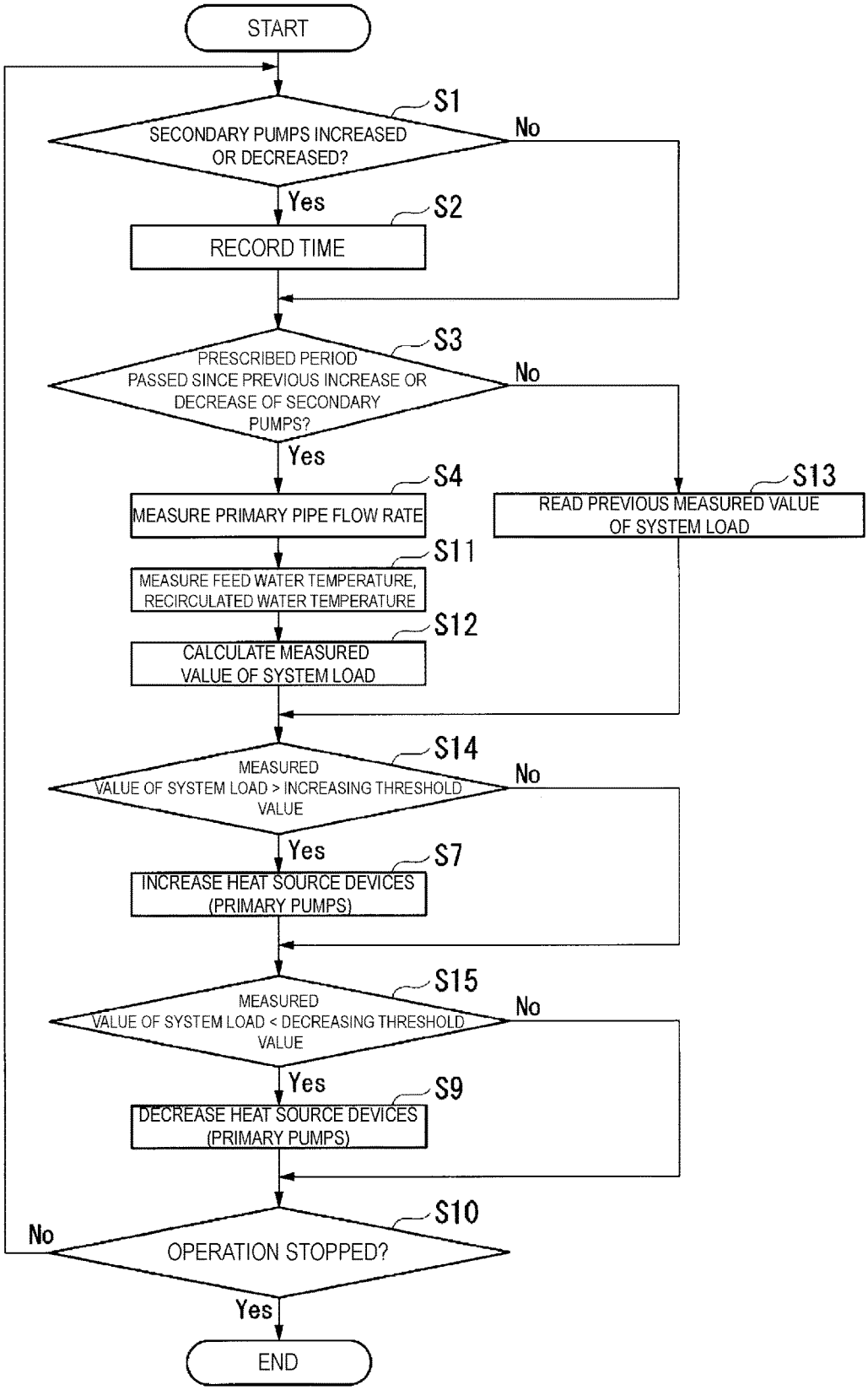
FIG. 4 is a second diagram illustrating the process flow of the device for controlling the number of operating heat source devices according to the first embodiment of the present invention.

FIG. 4 is a second diagram illustrating the process flow of the device for controlling the number of operating heat source devices according to the present embodiment.

The process by which the device for controlling the number of operating heat source devices 60 determines the number of operating heat source devices 30 using the "control method based on the system load measured value" is described using the process flow of FIG. 4. Processes that are the same as FIG. 3 are given the same reference sign and their description is simplified.

First, the unit for detecting a change in the number of operating secondary pumps 102 detects whether or not there has been an increase or decrease in the number of operating secondary pumps 20 (step S1), and if an increase or decrease is detected, the time that the change was detected is stored in the storage unit 200 (step S2).

Next, the unit for switching the number of operating heat source devices 101 compares the elapsed time from the previous time that the number of secondary pumps operating was changed until the present time with the duration of the transient state (step S3).

As a result of this comparison, if the duration of the transient state or longer has passed since increasing or decreasing the number of operating secondary pumps (step S3=Yes), the unit for switching the number of operating heat source devices 101 acquires the latest measured value of the primary pipe flow rate measured by the flow rate meter 41 via the load-side primary pipe flow volume acquisition unit 105 (step S4). Then the unit for switching the number of operating heat source devices 101 acquires the latest measured value of the feed water temperature measured by the thermometer 42 via the load-side feed water temperature acquisition unit 103, and the latest measured value of the recirculated water temperature measured by the thermometer 43 via the load-side recirculated water temperature acquisition unit 104 (step S11). Then the unit for switching the number of operating heat source devices 101 calculates the latest measured value of system load using the equation (1) and stores it in the storage unit 200 (step S12).

On the other hand, if the duration of the transient state has not passed since increasing or decreasing the number of operating secondary pumps (step S3=No), the unit for switching the number of operating heat source devices 101 reads from the storage unit 200 the last value of the measured system load before the previous time that the number of operating secondary pumps 20 was increased or decreased, as the latest measured value of the system load (step S13).

Next, the unit for switching the number of operating heat source devices 101 determines the increase or decrease in the number of operating heat source devices 30 or the like by the "control method based on the system load measured value" using the latest measured value of the system load.

First, the unit for switching the number of operating heat source devices 101 calculates the increasing load threshold value using, for example, equation (2). Then the latest measured value of the system load and the increasing load threshold value obtained in step S12 and step S13 are compared (step S14).

If as a result of the comparison the latest measured value of the system load exceeds the increasing load threshold value (step S14=Yes), the unit for switching the number of operating heat source devices 101 increases the number of heat source devices 30 and the like operating by one (step S7).

If as a result of the comparison the latest measured value of the system load is less than the increasing load threshold value (step S14=No), the process proceeds to step S15.

Next, the unit for switching the number of operating heat source devices 101 calculates the decreasing load threshold value using, for example, equation (3). Then the latest measured value of the system load and the decreasing load threshold value are compared (step S15).

If as a result of the comparison the latest measured value of the system load is less than the decreasing load threshold value (step S15=Yes), the unit for switching the number of operating heat source devices 101 decreases the number of heat source devices 30 and the like operating by one (step S9).

Finally, the unit for switching the number of operating heat source devices 101 determines the operating status of the heat source system, and if operation is continuing the process is repeated from step S1, and if the heat source system has stopped this process flow is terminated.

According to the "control method based on the system load measured value" of the present embodiment, for a certain duration while the primary pipe flow rate is fluctuating associated with an increase or decrease in the number of operating secondary pumps 20, the number of operating heat source devices 30 is controlled on the basis of the measured value of the system load measured prior to the increase or decrease, so it is possible to control the number of operating heat source devices 30 without being affected by the transient fluctuation in the measured value of the system load associated with the increase or decrease in the number of operating secondary pumps 20.

Second Embodiment

Figure 5:
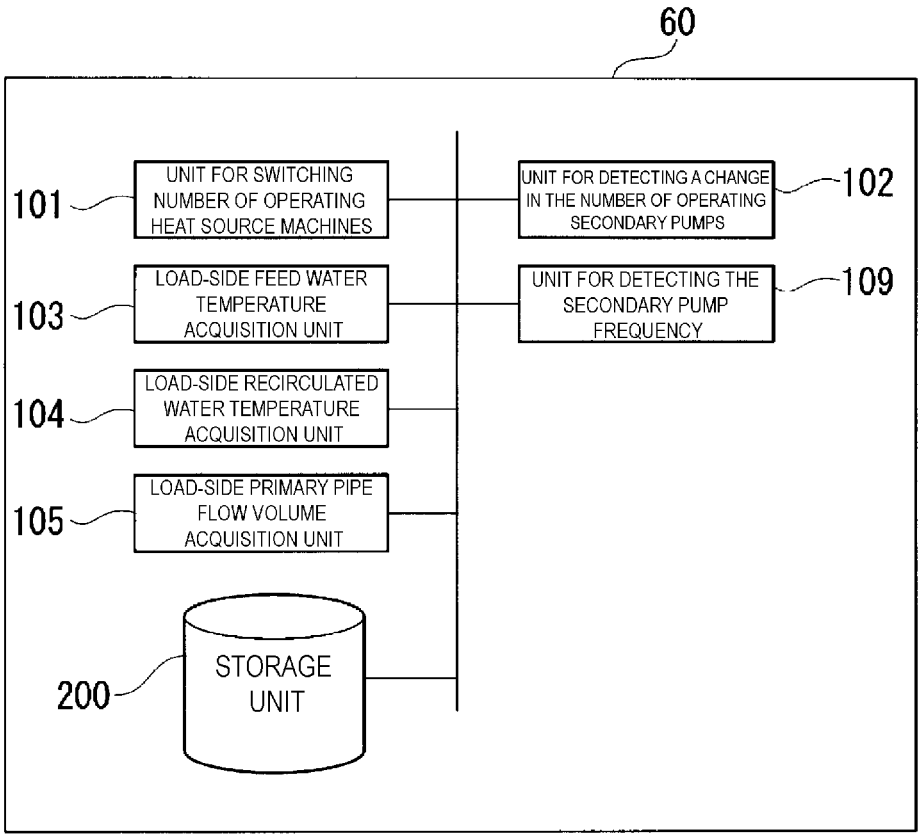
FIG. 5 is a function block diagram of a device for controlling the number of operating heat source devices according to the second embodiment of the present invention.
Figure 6:
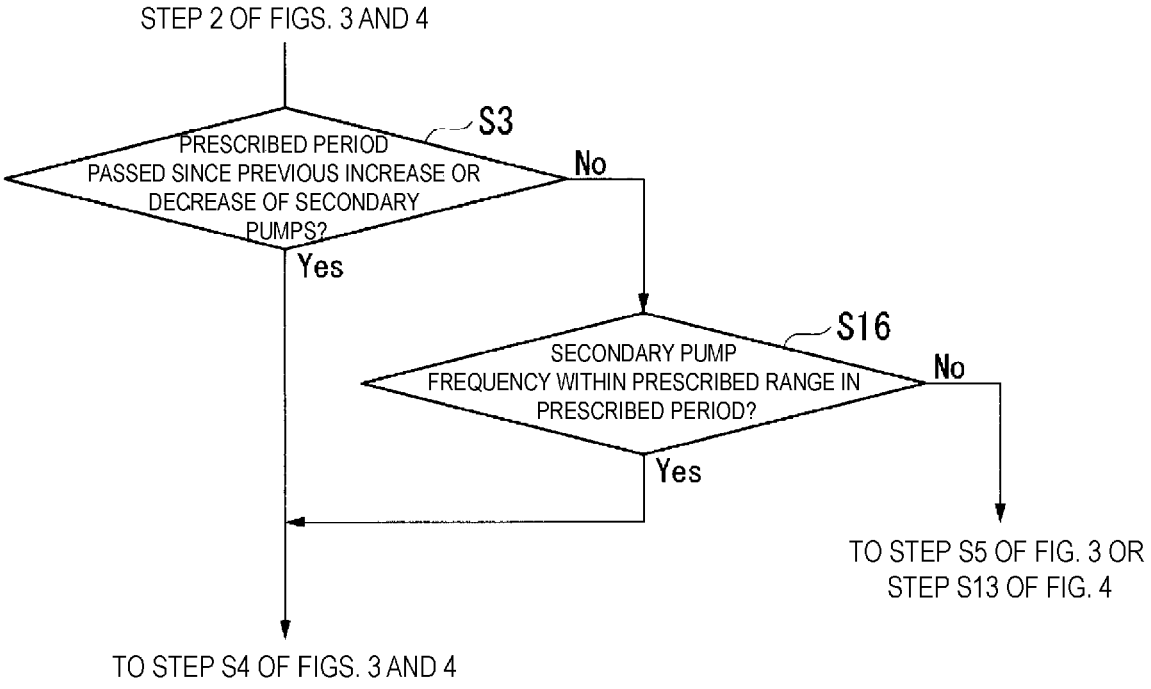
FIG. 6 is a first diagram illustrating the process flow of the device for controlling the number of operating heat source devices according to the second embodiment of the present invention.
Figure 7:
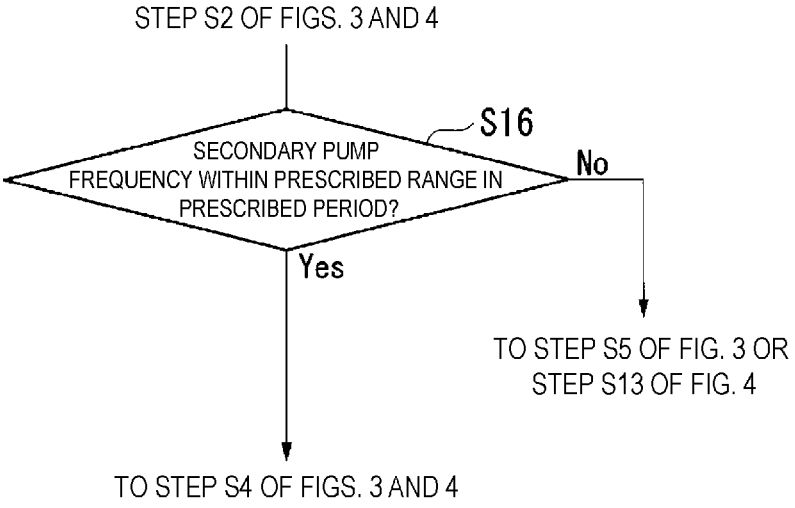
FIG. 7 is a second diagram illustrating the process flow of the device for controlling the number of operating heat source devices according to the second embodiment of the present invention.

The following is a description of the heat source system according to a second embodiment of the present invention, with reference to FIGS. 5 to 7.

FIG. 5 is a function block diagram of a device for controlling the number of operating heat source devices according to the present embodiment.

The device for controlling the number of operating heat source devices 60 of the present embodiment differs from the first embodiment in that it includes a unit for detecting the secondary pump frequency 109. The rest of the configuration of the present embodiment is the same as that of the first embodiment.

The unit for detecting the secondary pump frequency 109 acquires the pump frequency from each of the secondary pumps 20, and stores them in the storage unit 200 in correspondence with the time acquired. The pump frequency is the output frequency of the pump and a value that is theoretically proportional to the pump rotational speed or outlet flow rate. Alternatively the unit for detecting the secondary pump frequency 109 may acquire the pump frequency (frequency command value) from the secondary pump control device 80.

Note that when the number of operating secondary pumps 20 has changed, the unit for switching the number of operating heat source devices 101 in the present embodiment controls the number of operating heat source devices 30 on the basis of the load demand prior to changing the number of operating secondary pumps 20 in the time period until the frequency of the secondary pump 20 that fluctuates in accordance with the change has settled.

FIG. 6 is a first diagram illustrating the process flow of the device for controlling the number of operating heat source devices according to the second embodiment. FIG. 7 is a second diagram illustrating the process flow of the device for controlling the number of operating heat source devices according to the second embodiment. The process according to the present embodiment is described using FIGS. 6 and 7.

First, a method for controlling the increase or decrease in the number of operating heat source devices 30 and the like by adjusting the duration of the transient state to an appropriate value is described using the process flow of FIG. 6.

This process flow is the process of the determination in step S3 of the process flow of FIGS. 3 and 4 in the first embodiment.

As described for FIG. 3 or FIG. 4, it is assumed that when affected by an increase or decrease in the number of operating secondary pumps 20, the number of heat source devices 30 operating is controlled on the basis of the primary pipe flow rate or the measured value of the system load that was last stored prior to increasing or decreasing the number of operating secondary pumps. Also, the state in which the number of operating heat source devices 30 is controlled using the primary pipe flow rate or the measured value of the system load prior to increasing or decreasing the number of secondary pumps is referred to as the previous value holding state.

First, it is assumed that the unit for detecting a change in the number of operating secondary pumps 102 detects an increase or decrease in the number of operating secondary pumps 20, and the time of the increase or decrease is stored in the storage unit 200 (steps S1, S2 of FIGS. 3 and 4).

Then, the unit for switching the number of operating heat source devices 101 determines whether or not the duration of the transient state has passed since the increase or decrease in the number of operating secondary pumps (step S3).

If the duration of the transient state has not passed since increasing or decreasing the number of operating secondary pumps (step S3=No), the unit for switching the number of operating heat source devices 101 reads from the storage unit 200 the frequency of each of the secondary pumps 20 stored by the unit for detecting the secondary pump frequency 109, and determines whether or not the fluctuation in the frequency of each of the secondary pumps 20 in a predetermined period of time is within a predetermined range (step S16). For example the unit for switching the number of operating heat source devices 101 determines that the fluctuation in the frequency is within the predetermined range if the fluctuation in the frequency of each of the secondary pumps 20 is within +3 Hz in the most recent 60 second time period.

If as a result of the determination, the fluctuation in the frequency is within the predetermined range (step S16=Yes), the unit for switching the number of operating heat source devices 101 considers that the transient state due to the increase or decrease in the number of operating secondary pumps has passed and that a steady state has been achieved, and cancels the previous value holding state even if the elapsed time from increasing or decreasing the number of operating secondary pumps 20 is within the duration of the transient state. Then the process flow of the control of the number of operating heat source devices 30 according to the present embodiment proceeds to the process of step S4 of FIGS. 3 and 4.

If as a result of the determination, the fluctuation in the frequency is not within the predetermined range (step S16=No), the unit for switching the number of operating heat source devices 101 continues the previous value holding state. Then the process flow of the control of the number of operating heat source devices 30 according to the present embodiment proceeds to step S5 in the case of the process of FIG. 3, and to step S13 in the case of the process flow of FIG. 4.

With this the process flow of FIG. 6 terminates.

Note that in step S16 of the present embodiment, the determination process can be used on its own without combination with the first embodiment. In this case, as illustrated in FIG. 7, in the process flow of the control of the number of operating heat source devices 30 in the present embodiment, the process of step S16 is carried out instead of the process of step S3 in the process flow of FIGS. 3 and 4.

In the first embodiment, there is a possibility that the previous value holding state will be continued even though the transient state due to the increase or decrease in the number of operating secondary pumps 20 has already finished and a steady state has been established. In this case, tracking of the actual fluctuation in load demand by the heat source devices 30 is delayed. Alternatively, in the first embodiment, there is a possibility that the previous value holding state will be cancelled even though the transient state is continuing. In this case, it is not possible to sufficiently reduce the effect of the transient state due to the increase or decrease in the number of operating secondary pumps 20 on the control of the number of operating heat source devices 30.

On the other hand, according to the determination based on the frequency in the present embodiment (step S16), if the frequency of the secondary pumps 20 is within a certain range within a certain period of time, it is determined that the transient state due to the increase or decrease in the number of operating secondary pumps 20 has become settled, and the previous value holding state is canceled, so it is possible to cancel the previous value holding state at a more appropriate timing.

Also, when combined with the first embodiment as in FIG. 6, if the duration of the transient state can be set with a margin so that there is no danger that the previous value holding state will be canceled even though the transient state is continuing, the above problem can be solved by determining the timing for canceling the previous value holding state from the fluctuation in the frequency of the secondary pumps 20 as in the process flow of FIG. 6.

Also, by determination not only from the fluctuation of the frequency of the secondary pumps 20, but in combination with determination from the duration of the transient state, when the pump frequency is intentionally and continuously increased or decreased after increasing or decreasing the number of pumps, it is always possible to prevent continuation of the previous value holding state during this period.

Third Embodiment

Figure 8:
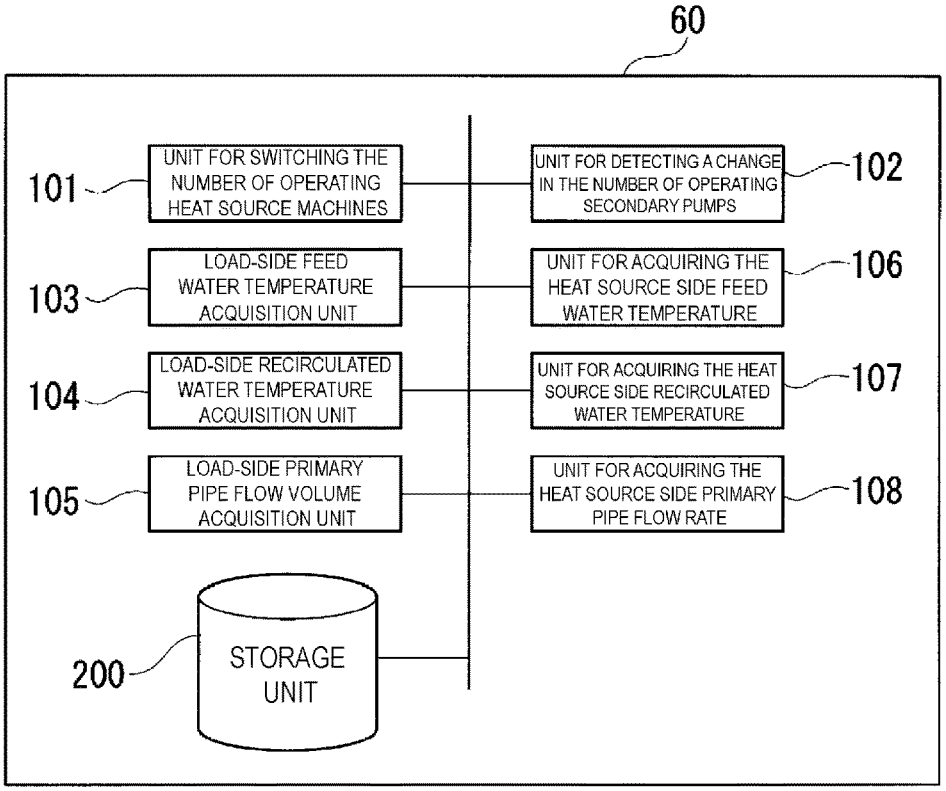
FIG. 8 is a function block diagram of a device for controlling the number of operating heat source devices according to the third embodiment of the present invention.
Figure 9:
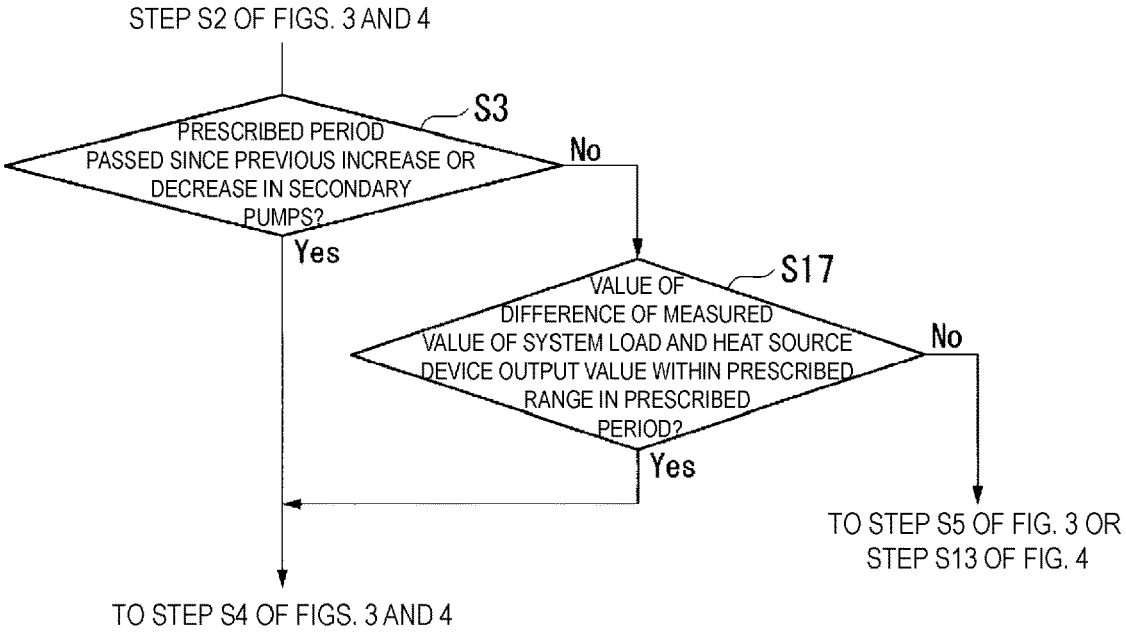
FIG. 9 is a first diagram illustrating the process flow of the device for controlling the number of operating heat source devices according to the third embodiment of the present invention.
Figure 10:
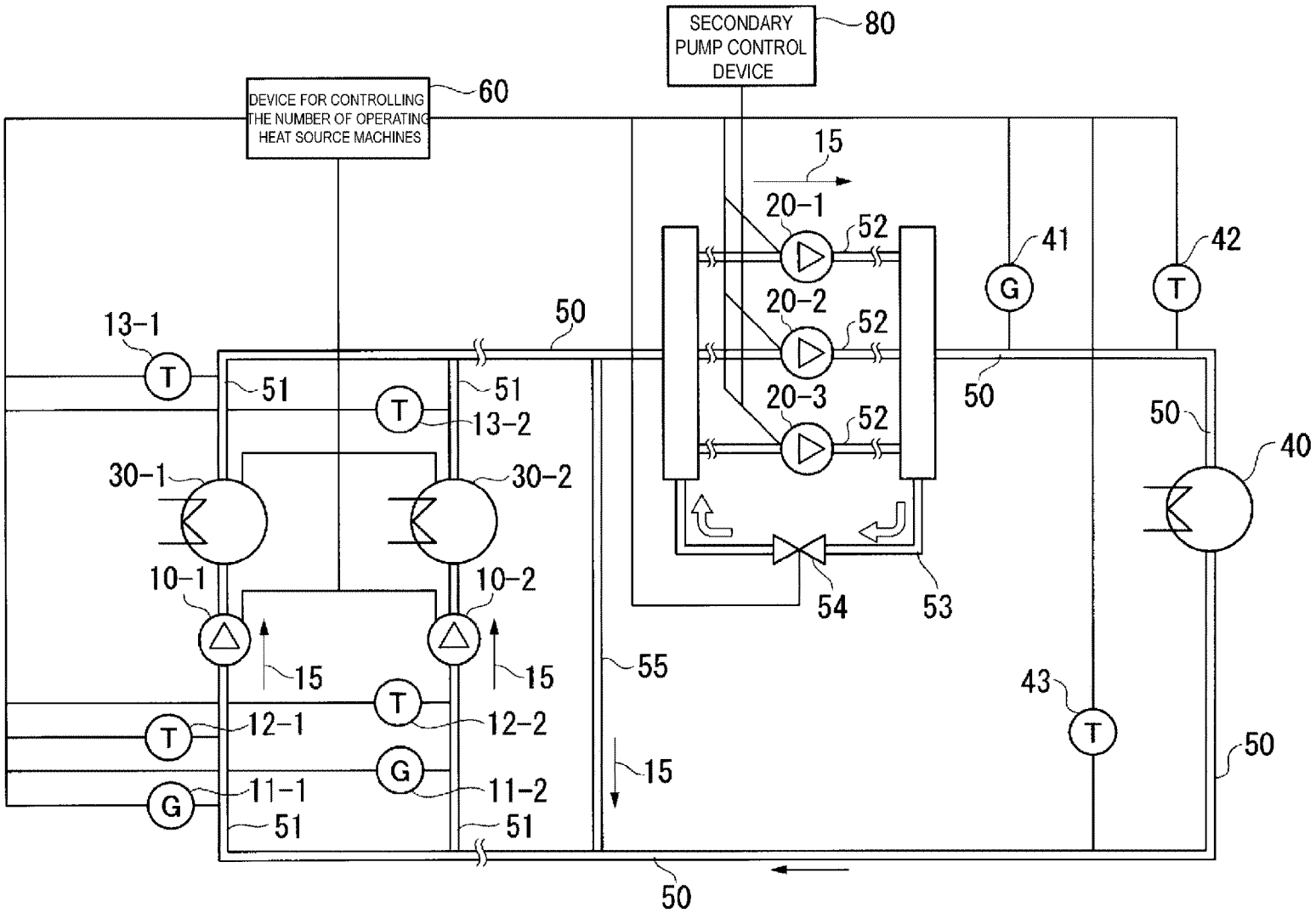
FIG. 10 is a schematic view of a heat source system according to a fourth embodiment of the present invention.

The following is a description of the heat source system according to a third embodiment of the present invention, with reference to FIGS. 8 to 10.

FIG. 8 is a function block diagram of a device for controlling the number of operating heat source devices according to the present embodiment.

The device for controlling the number of operating heat source devices 60 of the present embodiment differs from the first embodiment in that it includes a unit for acquiring the heat source side feed water temperature 106, a unit for acquiring the heat source side recirculated water temperature 107, and a unit for acquiring the heat source side primary pipe flow rate 108. The rest of the configuration of the present embodiment is the same as that of the first embodiment.

The unit for acquiring the heat source side feed water temperature 106 acquires the temperature of the heat transfer medium measured by the thermometer 13, and stores the temperature in correspondence with the time acquired in the storage unit 200.

The unit for acquiring the heat source side recirculated water temperature 107 acquires the temperature of the heat transfer medium measured by the thermometer 12, and stores the temperature in correspondence with the time acquired in the storage unit 200.

The unit for acquiring the heat source side primary pipe flow rate 108 acquires the flow rate of the heat transfer medium measured by the flow rate meter 11, and stores the flow rate in correspondence with the time acquired in the storage unit 200.

Note that when the number of operating secondary pumps 20 has changed, the unit for switching the number of operating heat source devices 101 in the present embodiment controls the number of operating heat source devices 30 on the basis of the load demand prior to changing the number of operating secondary pumps 20 in the time period until the value of the difference in the heat source device output value and the measured value of the load device that fluctuates in accordance with the change has settled.

FIG. 9 is a first diagram illustrating the process flow of the device for controlling number of operating heat source devices according to the third embodiment.

A method for controlling the number of operating heat source devices 30 by adjusting the duration of the transient state to an appropriate value, and that is different from the method of the second embodiment, is described using the process flow of FIG. 9.

This process flow is the process of the determination in step S3 of the process flow of FIGS. 3 and 4 in the first embodiment.

First, it is assumed that the unit for detecting a change in the number of operating secondary pumps 102 detects an increase or decrease in the number of operating secondary pumps 20, and the time of the increase or decrease is stored in the storage unit 200 (steps S1, S2 of FIGS. 3 and 4). Then, the unit for switching the number of operating heat source devices 101 determines whether or not the duration of the transient state has passed since the increase or decrease in the number of secondary pumps operating (step S3).

If the duration of the transient state since increasing or decreasing the number of operating secondary pumps has not passed (step S3=No), the unit for switching the number of operating heat source devices 101 reads from the storage unit 200 the load side feed water temperature stored by the load-side feed water temperature acquisition unit 103, the load side recirculated water temperature stored by the load-side recirculated water temperature acquisition unit 104, and the load side primary pipe flow rate stored by the load-side primary pipe flow volume acquisition unit 105 for a predetermined period of time, and calculates the measured value of system load for the time that these measured values were stored using equation (1). Also, the unit for switching the number of operating heat source devices 101 reads from the storage unit 200 the heat source side feed water temperature stored by the unit for acquiring the heat source side feed water temperature 106, the heat source side recirculated water temperature stored by the unit for acquiring the heat source side recirculated water temperature 107, and the heat source side flow rate acquired by the unit for acquiring the heat source side primary pipe flow rate 108 for a predetermined period of time, and calculates the output value of the heat source device for the heat source device 30-1 using the following equation (4).

$$\text{Heat source device output value of heat source device 30-1} = \text{value measured by flow rate meter 11-1} \times (|\text{value measured by thermometer 12-1} - \text{value measured by thermometer 13-1}|) \times \text{specific heat of heat transfer medium} \times \text{specific gravity of heat transfer medium} \quad (4)$$

The unit for switching the number of operating heat source devices 101 calculates the heat source device output value for other operating heat source devices 30-2 and the like in the same way. Then the unit for switching the number of operating heat source devices 101 adds the calculated heat source device output values for each of the heat source devices 30, to calculate the heat source device output value for all operating heat source devices 30 for the time at which each of the measured values was stored. Then the unit for switching the number of operating heat source devices 101 calculates the value of the difference of the calculated measured value of system load and the heat source device output value, and determines whether or not the value of this difference in a predetermined period of time is within a predetermined range (step S17).

As a result of this determination, if the fluctuation in the value of the difference is within the predetermined range at which the measured value of the system load and the heat source device output value can be considered to be equal (step S17=Yes), the unit for switching the number of operating heat source devices 101 considers the steady state to be already established and cancels the previous value holding state. Then the process flow of the control of the number of operating heat source devices 30 according to the present embodiment proceeds to step S4 of FIGS. 3 and 4.

If as a result of the determination, the fluctuation in the value of the difference is not within the predetermined range (step S17=No), the unit for switching the number of operating heat source devices 101 continues the previous value holding state. Then the process flow of the control of the number of operating heat source devices 30 according to the present embodiment proceeds to step S5 in the case of the process of FIG. 3, and to step S13 in the case of the process flow of FIG. 4.

With this the process flow of FIG. 9 terminates.

During steady state operation of the heat source system, the measured value of the system load and the heat source device output value are equal, so if the value of the difference in the measured value of the system load and the heat source device output value in the predetermined period of time are within a certain range in which the measured value of the system load and the heat source device output value can be considered to be equal, it can be determined that the transient state associated with the increase or decrease in the number of secondary pumps 20 operating has settled, and steady state operation has been achieved.

According to the present embodiment, the operating status of the heat source system is evaluated using the measured value of the system load and the heat source device output value which more directly indicates the status of the heat source system, so it is possible to cancel the previous value hold at a more appropriate timing.

Note that in step S17 of the present embodiment, the determination process can be used on its own without combination with the first embodiment. Also, it can be combined with the second embodiment.

Also, in the above description an example was presented in which the heat source device output value is obtained for each single heat source device 30 on the piping 51 on which is installed the flow rate meter 11, the thermometer 12, and the thermometer 13. However the heat source device output value may be obtained for all of the heat source devices 30 by installing the flow rate meter 11, the thermometer 12, and the thermometer 13 on the piping 50 near where the heat source device 30 is provided.

Fourth Embodiment

The following is a description of the heat source system according to a fourth embodiment of the present invention, with reference to FIGS. 10 to 13.

The present embodiment can only be applied when there is a transient rise in the primary pipe flow rate, and as a rule relates to the control of the number of operating heat source devices 30 when the number of operating secondary pumps is increased.

FIG. 10 illustrates an example of the heat source system according to the present invention. In the heat source system according to the present embodiment, a secondary bypass 53 is provided in parallel with the group of secondary pumps. The secondary bypass 53 has the action of returning the heat transfer medium that has passed through the secondary pumps 20 to the inlet side of the secondary pumps, and adjusting the flow rate of the heat transfer medium from the secondary pumps 20 to the load device 40. In addition a secondary bypass adjustment valve 54 is provided on the secondary bypass 53. The secondary bypass adjustment valve 54 adjusts the flow rate of the heat transfer medium flowing in the secondary bypass 53.

Figure 11:
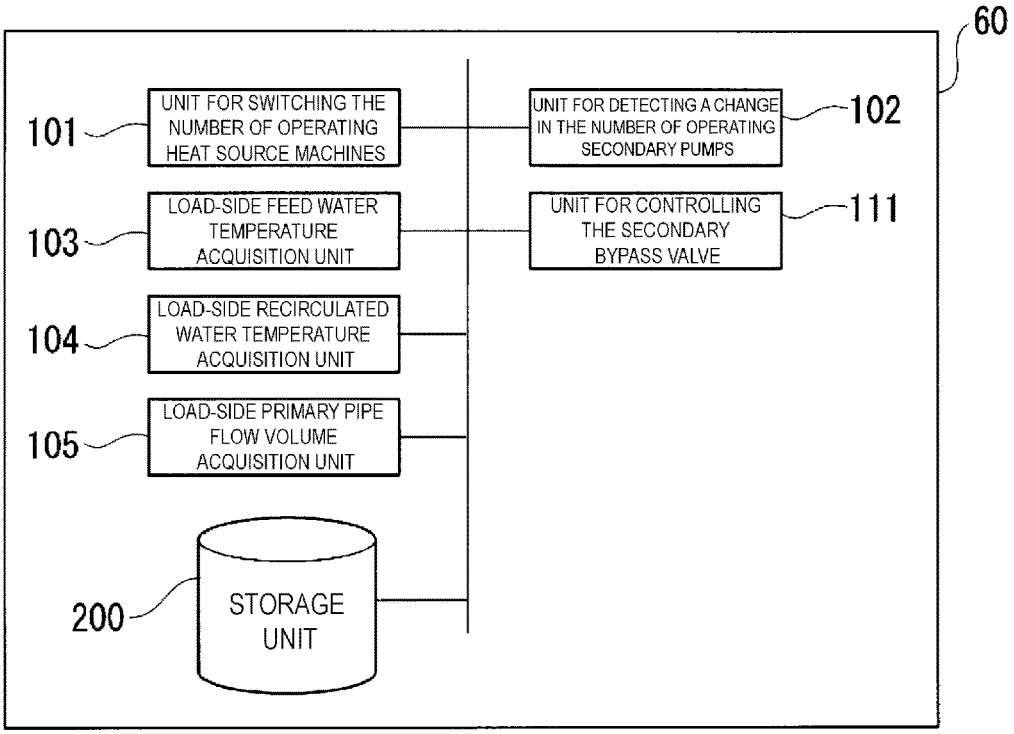
FIG. 11 is a function block diagram of a device for controlling the number of operating heat source devices according to the fourth embodiment of the present invention.

FIG. 11 is a function block diagram of a device for controlling the number of operating heat source devices according to the present embodiment.

The device for controlling the number of operating heat source devices 60 of the present embodiment differs from the first embodiment in that it includes a unit for controlling the secondary bypass valve 111. The rest of the configuration of the present embodiment is the same as that of the first embodiment.

The unit for controlling the secondary bypass valve 111 controls the degree of opening of the secondary bypass adjustment valve 54 in order to adjust the heat transfer medium returning through the secondary bypass to the required flow rate. The unit for controlling the secondary bypass valve 111 has a function for performing feedback control such as proportional integral (PI) control.

Figure 12:
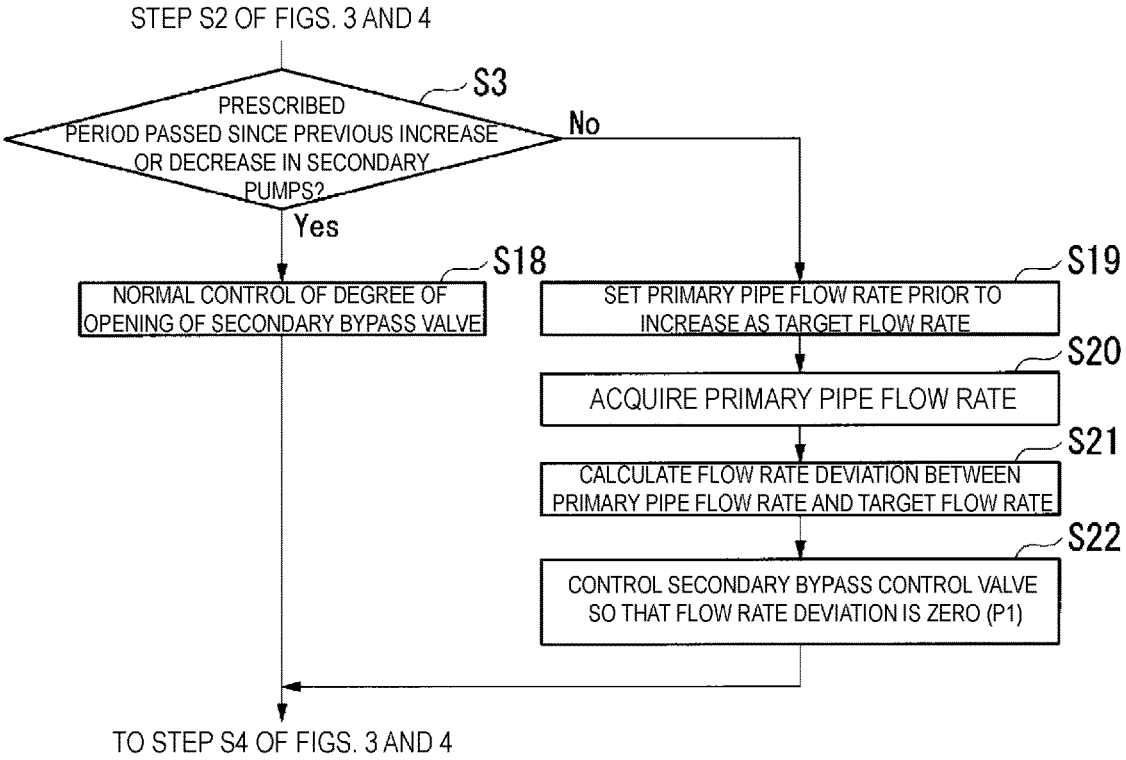
FIG. 12 is a first diagram illustrating the process flow of the device for controlling the number of operating heat source devices according to the fourth embodiment of the present invention.

FIG. 12 is a first diagram showing the process flow of the device for controlling the number of operating heat source devices according to the fourth embodiment.

The method of controlling the increase or decrease in the number of operating heat source devices 30 in the fourth embodiment is described using the process flow of FIG. 12. Processes that are the same as FIG. 3 are given the same reference sign and their description is simplified.

It is assumed that the primary pipe flow rate is controlled so that it is equal before and after increasing the number of operating secondary pumps.

First, it is assumed that the unit for detecting a change in the number of operating secondary pumps 102 detects an increase or decrease in the number of operating secondary pumps 20, and the time of the increase or decrease is stored in the storage unit 200 (steps S1, S2 of FIGS. 3 and 4). Then, the unit for switching the number of operating heat source devices 101 determines whether or not a predetermined period of time has passed since the increase or decrease in the number of operating secondary pumps (step S3).

If the duration of the transient state has not passed since increasing the number of secondary pumps (step S3=No), first the unit for controlling the secondary bypass valve 111 sets the primary pipe flow rate before the increase as the target flow rate (step S19). Next, the unit for controlling the secondary bypass valve 111 acquires the latest primary pipe flow rate via the load-side primary pipe flow volume acquisition unit 105 (step S20). Then the unit for controlling the secondary bypass valve 111 calculates the deviation between the predetermined target flow rate and the latest primary pipe flow rate (step S21), and carries out feedback control of the secondary bypass adjustment valve 54 so that the deviation becomes zero (S22).

In the period of time until the duration of the transient state stored in the storage unit 200 has passed, the unit for controlling the secondary bypass valve 111 continues to control the secondary bypass adjustment valve 54 in order to eliminate the transient increase in the primary pipe flow rate due to the increase in the number of operating secondary pumps.

On the other hand, if the duration of the transient state since increasing the number of operating secondary pumps 20 has passed (step S3=Yes), the unit for controlling the secondary bypass valve 111 controls the degree of opening of the secondary bypass adjustment valve 54 so that it is a predetermined value used during normal operation and not that during increase in the number of operating secondary pumps (step S18).

The subsequent processing steps are the same as step S4 of FIGS. 3 and 4 and beyond in the process flow of the first embodiment.

In the present embodiment, the unit for switching the number of operating heat source devices 101 does not control the number of operating heat source devices 30 in the time period from increasing or decreasing the number of operating secondary pumps 20 until a predetermined condition is satisfied, using the primary pipe flow rate before increasing or decreasing the number of secondary pumps operating or the measured value of the system load, as in the first to third embodiments. The unit for switching the number of operating heat source devices 101 controls the number of operating heat source devices 30 by the "control method based on the primary pipe flow rate" or the "control method based on the system load measured value" in the normal way when the number of secondary pumps 20 is increased or decreased. However, in the time period until the duration of the transient state has passed, the unit for controlling the secondary bypass valve 111 controls the secondary bypass adjustment valve 54, and by minimizing the temporary increase or decrease in the primary pipe flow rate, the unit for switching the number of operating heat source devices 101 does not allow an inappropriate increase or decrease in the number of heat source devices 30 operating, the same as for the first embodiment.

According to the present embodiment, it is possible to control the number of operating heat source devices 30 without substituting the measured value of the primary pipe flow rate or the measured value of the system load. In other words, there is the advantage that the control of the number of units operating by the unit for switching the number of operating heat source devices 101 may be the same during normal situations and when the number of operating secondary pumps has been increased or decreased.

Also, the period in which feedback control is carried out by the unit for controlling the secondary bypass valve 111 may be the period of time until the frequency of the secondary pump is within a predetermined range as in the second embodiment, or, it may be the period of time until the deviation between the measured value of the system load and the heat source device side heat source device output value is within the predetermined range as in the third embodiment.

Figure 13:
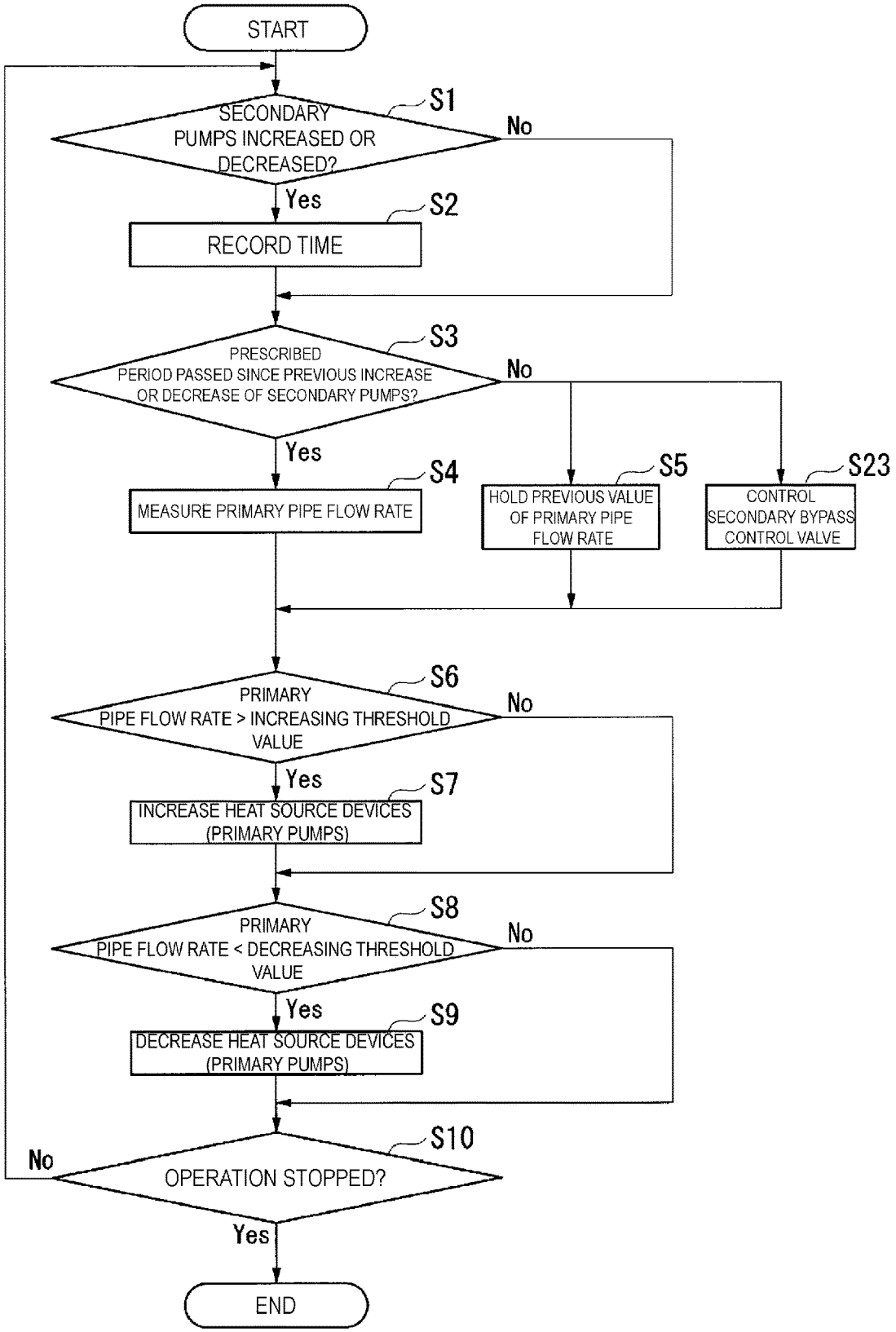
FIG. 13 is a second diagram illustrating the process flow of the device for controlling the number of operating heat source devices according to the fourth embodiment of the present invention.

Note that the unit for controlling the secondary bypass valve 111 according to the present embodiment can combine the first to third embodiments. FIG. 13 illustrates an example of the process flow in the case of combination with the first embodiment.

FIG. 13 is a process flow in which the "control method based on the primary pipe flow rate" described in FIG. 3 for the first embodiment is combined with the present embodiment. The differences from the process flow of FIG. 3 only are described.

In the present process flow, in step S3 if the unit for switching the number of operating heat source devices 101 determines that the duration of the transient state has not passed since increasing the number of operating secondary pumps (step S3=No), the unit for switching the number of operating heat source devices 101 controls the number of operating heat source devices 30 by holding the previous value (step S5). Also, in parallel with this the unit for controlling the secondary bypass valve 111 controls the secondary bypass adjustment valve 54, to suppress the fluctuation in the primary pipe flow rate due to the increase in the number of operating secondary pumps (step S23). The contents of the process of step S23 is a process equivalent to step S19 to step 22 in FIG. 12.

By combining the present embodiment and the first embodiment in this way, it is possible to prevent increasing the number of heat source devices 30 operating inappropriately in association with the transient increase in the primary pipe flow rate when increasing the number of operating secondary pumps. Also, by controlling the secondary bypass adjustment valve 54, the time period of the transient state of the primary pipe flow rate is shortened, and the temporary increase in the primary pipe flow rate can be suppressed, so the heat source system can be operated more stably. Also, the time period in which the previous value holding state is maintained when the number of secondary pumps is increased can be shortened, so this is effective for the problem of a delay in the heat source device 30 tracking the actual fluctuations in the load demand. These effects are also obtained when combined with the second or the third embodiment.

Note that the device for controlling the number of operating heat source devices includes a computer. Also, the steps of each process of the device for controlling the number of operating heat source devices are stored in a computer readable storing medium in the form of a program, and by the computer reading out and executing this program the above processes are implemented. Here the computer readable storing medium refers to a magnetic disk, a magneto-optical disk, a CD-ROM, a DVD-ROM, a semiconductor memory, or the like. Also, this computer program may be distributed to the computer on a communication circuit, and the computer that receives this distribution may execute the program.

Also, the program as described above may realize a portion of the functions described above. In addition, the functions as described above may be realized in combination with a program already stored on the computer system, a so-called differential file (differential program).

In addition, the constituent elements in the embodiments as described above can be replaced as appropriate with commonly known constituent elements, to the extent that it does not deviate from the intention of the present invention. Also the technical scope of the present invention is not limited to the embodiments described above, and various modifications may be further made without deviating from the spirit of the present invention.

INDUSTRIAL APPLICABILITY

According to the device for controlling the number of operating heat source devices, the heat source system, the control method, and the program as described above, it is possible to control the number of operating heat source devices appropriately without being affected by a transient change in the flow volume measurement value or measured load value caused by a change in the number of operating secondary pumps.

REFERENCE SIGNS LIST

10 Primary pump
11 Flow rate meter
12, 13 Thermometer
20 Secondary pump
40 Air conditioner
41 Flow rate meter
42, 43 Thermometer
50, 51, 52, 55 Piping
53 Secondary bypass
54 Secondary bypass adjustment valve
60 Device for controlling the number of operating heat source devices
80 Secondary pump control device
101 Unit for switching the number of operating heat source devices
102 Unit for detecting a change in the number of operating secondary pumps
103 Load-side feed water temperature acquisition unit
104 Load-side recirculated water temperature acquisition unit
105 Load-side recirculated water temperature acquisition unit
106 Unit for acquiring the heat source side feed water temperature
107 Unit for acquiring the heat source side recirculated water temperature
108 Unit for acquiring the heat source side primary pipe flow rate
109 Unit for detecting the secondary pump frequency
111 Unit for controlling the secondary bypass valve
200 Storage unit

The invention claimed is:

1. A controller for controlling a number of operating heat sources, the controller configured to performing the steps of:

detecting a change in a number of secondary pumps provided between a load device and a heat source to which a heat transfer medium is provided to the heat source by a primary pump, the secondary pumps transporting and supplying the heat transfer medium from the heat source to the load device; and determining the number of operating heat sources on the basis of the state of the load device and switching the number of operating heat sources, wherein, in the determining step, the controller determines the number of operating heat sources, that changes as a load demand of the state of the load device changes, when the change in the number of secondary pumps due to the change in the load demand is detected, and changes the number of heat sources for as long as at least one of a prescribed period has passed from a time when the change in the number of secondary pumps is detected or a prescribed condition with respect to a value that varies due to the change in the number of secondary pumps is satisfied.

2. The controller for controlling the number of operating heat sources according to claim 1, wherein the prescribed period is a predetermined period of time that has passed from a time when the change in the number of secondary pumps is detected or a period of time set in accordance with operating conditions has passed from a time when the change in the number of secondary pumps is detected.

3. The controller for controlling the number of operating heat sources according to claim 1, wherein the prescribed condition with respect to the value that varies is a frequency of a secondary pump that varies due to the change in the number of secondary pumps becoming a value within a prescribed range in a prescribed period of time.

4. The controller for controlling the number of operating heat sources according to claim 1, wherein the prescribed condition with respect to the value that varies is a difference between a heat source output value of the heat source that varies due to the change in the number of secondary pumps and a measured value of the load of the load device becoming a value within a prescribed range in which the heat source output value and the measured value of the load can be considered to be equal.

5. The controller for controlling the number of operating heat sources according to claim 1, wherein the controller is further configured to performing the step of:

controlling a degree of opening of a secondary bypass adjustment valve that adjusts a flow rate of a secondary bypass connected in parallel to the secondary pump, and wherein when the change in the number of secondary pumps is detected, the controller controls the secondary bypass adjustment valve so that the flow rate of the heat medium transported to the load device from the secondary pump becomes a target flow rate.

* * * * *